US006925814B2

(12) United States Patent
Wilson et al.

(10) Patent No.: US 6,925,814 B2
(45) Date of Patent: Aug. 9, 2005

(54) HYBRID TURBINE TIP CLEARANCE CONTROL SYSTEM

(75) Inventors: Kevin Wilson, Brampton (CA); Guy Bouchard, Mont St-Hilaire (CA); Jerzy Makuszewski, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 125 days.

(21) Appl. No.: 10/426,051

(22) Filed: Apr. 30, 2003

(65) Prior Publication Data

US 2005/0126181 A1 Jun. 16, 2005

(51) Int. Cl.[7] ..... F02C 7/18
(52) U.S. Cl. ..... 60/785; 60/806; 415/178
(58) Field of Search ..... 60/785, 806; 415/116, 415/117, 178

(56) References Cited

U.S. PATENT DOCUMENTS

| | | | | |
|---|---|---|---|---|
| 3,975,901 | A | | 8/1976 | Hallinger et al. |
| 4,069,662 | A | | 1/1978 | Redinger, Jr. et al. |
| 4,257,222 | A | | 3/1981 | Schwarz |
| 4,332,133 | A | | 6/1982 | Schwarz et al. |
| 4,338,061 | A | * | 7/1982 | Beitler et al. ..... 415/178 |
| 4,358,926 | A | | 11/1982 | Smith |
| 4,441,314 | A | | 4/1984 | Fitton |
| 4,462,204 | A | | 7/1984 | Hull |
| 4,513,567 | A | | 4/1985 | Deveau et al. |
| 4,576,547 | A | | 3/1986 | Weiner et al. |
| 4,596,116 | A | | 6/1986 | Mandet et al. |
| 4,679,981 | A | | 7/1987 | Guilbert et al. |
| 4,849,895 | A | | 7/1989 | Kervistin |
| 4,856,272 | A | | 8/1989 | Putman et al. |
| 4,893,984 | A | | 1/1990 | Davison et al. |
| 4,928,240 | A | | 5/1990 | Davison et al. |
| 4,999,991 | A | | 3/1991 | Haddad et al. |
| 5,048,288 | A | | 9/1991 | Bessette et al. |
| 5,064,343 | A | * | 11/1991 | Mills ..... 415/173.3 |
| 5,088,885 | A | | 2/1992 | Schwarz et al. |
| 5,154,578 | A | | 10/1992 | Miraucourt et al. |
| 5,281,085 | A | | 1/1994 | Lenahan et al. |
| 5,553,999 | A | | 9/1996 | Proctor et al. |
| 5,562,408 | A | | 10/1996 | Proctor et al. |
| 5,593,277 | A | | 1/1997 | Proctor et al. |
| 5,836,347 | A | | 11/1998 | Harries |
| 5,993,150 | A | | 11/1999 | Liotta et al. |
| 6,152,685 | A | | 11/2000 | Hagi |
| 6,435,823 | B1 | | 8/2002 | Schroder |
| 6,464,200 | B1 | | 10/2002 | Hines et al. |
| 6,487,491 | B1 | | 11/2002 | Karpman et al. |
| 6,513,328 | B2 | | 2/2003 | Baeuerle et al. |
| 6,526,746 | B1 | | 3/2003 | Wu |

FOREIGN PATENT DOCUMENTS

| | | |
|---|---|---|
| GB | 1 581 566 | 12/1980 |
| GB | 1 581 855 | 12/1980 |

* cited by examiner

*Primary Examiner*—Louis J. Casaregola
(74) *Attorney, Agent, or Firm*—Ogilvy Renault

(57) ABSTRACT

A turbine shroud cooling system used in a gas turbine engine for controlling tip clearance between a turbine shroud assembly and turbine rotor blades comprises a cooling air passage for selectively directing a cooling air flow between components to be cooled and a turbine shroud support assembly for controlling the tip clearance and then later re-directing the cooling air flow to cool a downstream turbine component.

7 Claims, 3 Drawing Sheets

HYBRID TURBINE TIP CLEARANCE CONTROL SYSTEM

FIELD OF THE INVENTION

The present invention generally relates to gas turbine engines, and more particularly to clearance control between turbine rotor blade tips and a stator shroud assembly radially spaced apart therefrom.

BACKGROUND OF THE INVENTION

A gas turbine engine includes in serial flow communication, one or more compressors followed in turn by a combustor and high and low pressure turbines, disposed symmetrically about a longitudinal axis centerline within an annular outer casing.

Each of the turbines includes one or more stages of rotor blades extending radially outwardly from respective rotor disks, with the blade tips being disposed closely adjacent to a turbine shroud assembly supported within the casing. It is desirable to maintain the gap between the blade tips and the shroud assembly as small as possible throughout the engine operation range because the combustion gas flowing therethrough bypasses the turbine blades and therefore provides no useful contribution. However, because the material of the stator components and the turbine rotor are different, and because inertia has an influence on the expansion of the rotor, the stator components, i.e. the engine case, outer air seal, and support mechanism, expand at a different rate than the expansion of the rotor. Therefore, the gap must be sized larger than would otherwise be desirable.

Conventionally, small gas turbine engines typically use a passive tip clearance control system when attempts are made to optimize the thermal response characteristics of the rotor and the casing. Full pressure compressor air is used both as the cooling medium and as the air seals around the blade tips, and is then exhausted into the turbine combustion gas path. When operating the engine during a transitional period, the thermal response rates of the casing and the rotor blades are difficult to match, thereby resulting in a pinch-point. This pinch-point causes a system limitation as to the minimum achievable tip clearance without rubbing.

Larger engines usually use active tip clearance control where inter-stage compressor bleed air is used to externally cool the turbine casing, typically in an impingement manner. This inter-stage compressor bleed air can be turned off by a valve during initial operation so as to avoid the pinch-point. When the engine has thermally stabilized, the valve is opened and the turbine casing effectively contracts to minimize tip clearance. Typically, this inter-stage compressor bleed air is dumped into the nacelle and lost to the cycle after having cooled the turbine casing.

Various efforts have been made to improve turbine tip clearance control in gas turbine engines. Examples of those efforts are illustrated in U.S. Pat. No. 4,513,5697 to Deveau et al. on Apr. 30, 1985; U.S. Pat. Nos. 5,593,277, 5,562,408 and 5,553,999 issued to Proctor et al. on Jan. 14, 1997, Oct. 8, 1996 and Sep. 10, 1996 respectively; U.S. Pat. No. 5,048,288, issued to Bessette et al. on Sep. 17, 1991; U.S. Pat. No. 4,358,926, issued to Smith on Nov. 16, 1982; and U.S. Pat. No. 6,487,491, issued to Karpman et al. on Nov. 26, 2002. These prior art patents disclose method, systems and apparatuses for improving turbine tip clearance control in one or more aspects of this matter. Nevertheless, continuous efforts to develop the technology in this field are still needed in order to achieve better performance of gas turbine engines, particularly for use with aircraft. The prior art offers complex solutions and solutions which do not maximize the efficiency of cooling air systems in the engine. Improvements are therefore desired.

SUMMARY OF THE INVENTION

One object of the present invention is to provide a turbine tip clearance control system for improving tip clearance control preferably without extra cooling air consumption, thereby improving overall gas turbine engine performance. Other objects will be apparent from this disclosure.

In accordance with one aspect of the present invention, there is provided a turbine shroud support configuration used in a gas turbine engine, for supporting a turbine shroud assembly having a plurality of turbine shroud segments radially spaced apart from a plurality of turbine rotor blades, and further for controlling tip clearance therebetween. The turbine shroud support configuration comprises an annular housing adapted to be secured within a turbine support case, and means attached to an inner side of the annular housing for supporting the respective turbine shroud segments in place. A first cooling air passage is provided for directing a first cooling air flow passing therethrough, thereby controlling the tip clearance between the turbine shroud segments and the turbine rotor blades. The first cooling air passage is defined at least by the annular housing and is isolated from a combustion gas path defined within the turbine shroud assembly. The first cooling air passage is in fluid communication with a downstream cooling air passage of the gas turbine engine for further directing the first cooling air flow to cool a turbine component downstream of the turbine rotor blades.

In this turbine shroud support configuration of the present invention, the means for supporting the respective shroud segments in place comprises a plurality of shroud support segments forming an annular ring assembly to secure the turbine shroud assembly within the shroud housing. The annular ring assembly defines a second cooling air passage for directing a second cooling air flow to cool the annular ring assembly and the turbine shroud segments assembly.

In accordance with another aspect of the present invention, there is provided a turbine shroud cooling system used in a gas turbine engine having a turbine shroud assembly including a plurality of turbine shroud segments radially spaced apart from a plurality of turbine rotor blades, for controlling tip clearance therebetween. The turbine shroud cooling system comprises a first cooling air passage for selectively directing a first cooling air flow to cool a turbine shroud support assembly, thereby controlling the tip clearance between the turbine shroud segments and the turbine rotor blades. The first cooling air passage is isolated from a combustion gas path defined within the turbine shroud assembly and is in fluid communication with a downstream cooling air passage of the gas turbine engine for directing the first cooling air flow to cool a turbine component downstream of the turbine rotor blades after the first cooling air flow cools the turbine shroud support assembly.

The turbine shroud cooling system of the present invention preferably comprises a second cooling air passage in fluid communication with a combustion gas path defined within the turbine shroud assembly, for directing a second cooling air flow to cool the turbine shroud assembly and further discharging the second cooling air flow into the combustion gas path after the second cooling air flow cools the turbine shroud assembly.

In accordance with a further aspect of the present invention, there is provided a method used with a gas turbine engine for controlling tip clearance between a plurality of turbine rotor blades and a turbine shroud assembly including a plurality of turbine shroud segments radially spaced apart from the respective turbine rotor blades. The method of the present invention comprises directing a first cooling air flow to cool a turbine shroud support assembly, thereby controlling the tip clearance between the turbine shroud segments and the turbine rotor blades and then directing the entire amount of the first cooling air flow that has cooled the turbine shroud support assembly, further to cool the turbine component downstream of the turbine rotor blades.

The method of the present invention preferably comprises a step of directing a second cooling air flow independent from the first cooling air flow, to cool the turbine shroud assembly, and further discharging the second cooling air flow into a combustion gas-path defined within the turbine shroud assembly.

In one embodiment of the present invention, the second cooling air flow is introduced from a full pressure compressor air flow and cools the turbine shroud assembly continuously during the engine operation including a startup period thereof so that the turbine shroud segments will generally thermally respond to the full pressure compressor air temperature. Then, when the gas turbine engine has thoroughly stabilized and the pinch-point has been avoided, the first cooling air flow is used to cool the annular shroud housing. This first cooling air flow is introduced from the inter-stage compressor bleed air and can be regulated, for example by a control valve. Using inter-stage compressor bleed air for cooling the annular shroud housing provides more flexibility for tuning turbine tip clearance because the inter-stage compressor bleed air is from a lower temperature cooling source. The first cooling air flow, after being used to cool the annular shroud housing, is not wasted but is substantially re-used for cooling, for example the low pressure turbine stage one vanes. The benefit of re-using the first cooling air flow lies in that it minimizes parasitic secondary air system losses. It should also be noted that the double shroud support assembly configuration is adapted to accommodate the large thermal gradient from the gas path to the turbine support case, which contributes to achieving lower turbine support assembly temperatures, in contrast to prior art passive cooling systems. Therefore, overall engine performance is improved.

Other advantages and features of the present invention will be better understood with reference to a preferred embodiment described hereinafter.

BRIEF DESCRIPTION OF THE DRAWINGS

Having thus generally described the nature of the present invention, reference will now be made to the accompanying drawings, showing by way of illustration the preferred embodiment thereof, in which.

DETAILED DESCRIPTION OF THE PREFERRED EMBODIMENT

Figure 1:
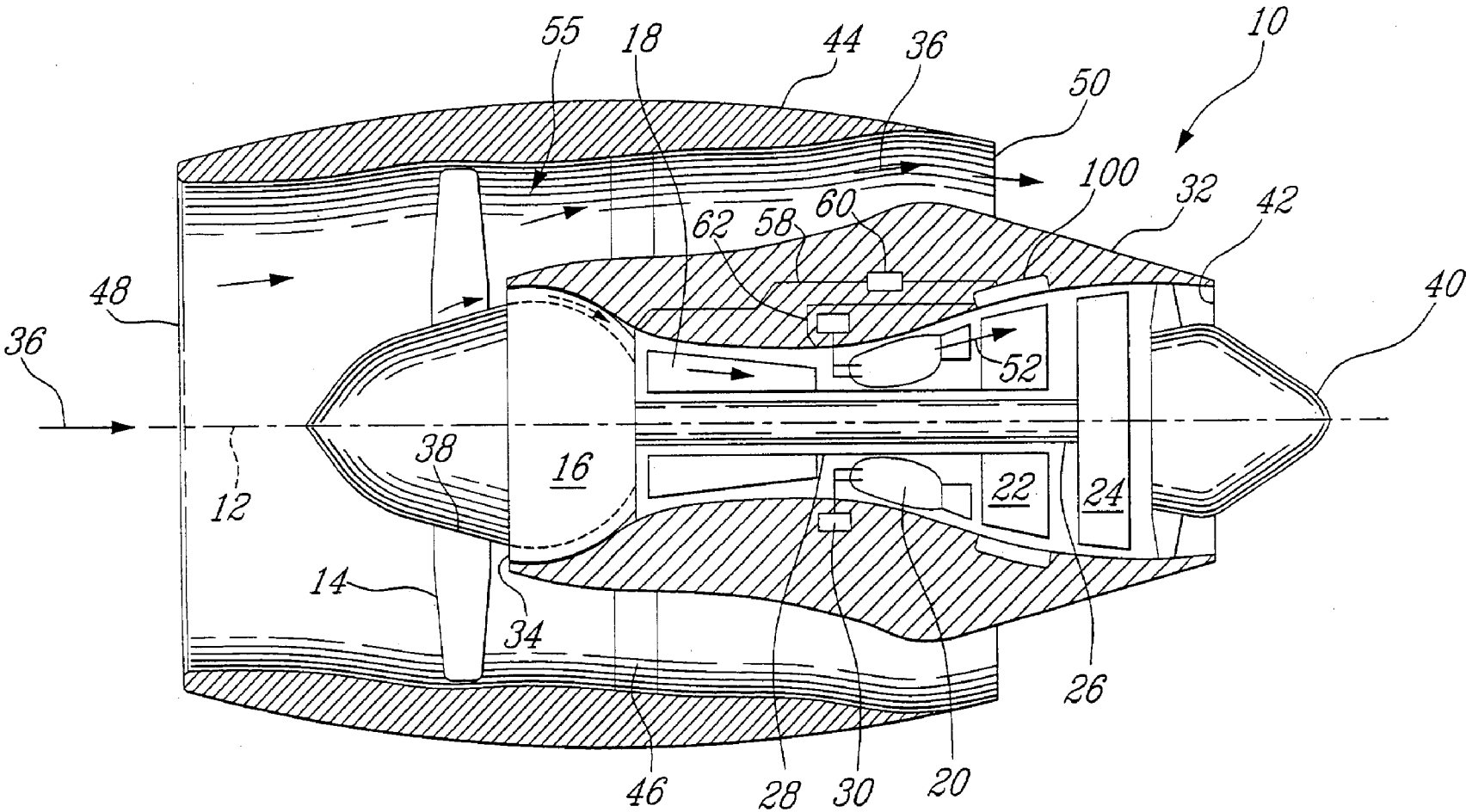
FIG. 1 is a longitudinal cross-sectional schematic view of a gas turbine engine incorporating one embodiment of the present invention.

Referring to the drawings, particularly FIG. 1, a exemplary gas turbine engine 10 includes in serial flow communication about a longitudinal central axis 12, a fan having a plurality of circumferentially spaced apart fan or rotor blades 14, a conventional low pressure compressor 16, a conventional high pressure compressor 18, a conventional annular combustor 20, a high pressure turbine 22 which includes a turbine shroud support configuration 100 according to one embodiment of the present invention, and a conventional low pressure turbine 24. The low pressure turbine 24 is securely connected to both the low pressure compressor 16 and the fan blades 14 by a first rotor shaft 26, and the high pressure turbine 22 is securely connected to the high pressure compressor 18 by a second rotor shaft 28. Conventional fuel injecting means 30 are provided for selectively injecting fuel into the combustor 20, for powering the engine 10.

A conventional annular casing 32 surrounds the engine 10 from the low pressure compressor 16 to the low pressure turbine 24, and defines, with the low pressure compressor 16, a low pressure compressor inlet 34 for receiving a portion of ambient air 36. The downstream end of the casing 32 defines with a conventional annular exhaust plug 40, an annular exhaust outlet 42. A portion of the air 36 compressed by the fan blades 14 adjacent to the blade roots 38, is further compressed by the low pressure compressor 16 and the high pressure compressor 18, to be forced into the combustor 20. The mixture of the compressed air 36 and the fuel injected by the fuel injecting means 30, generates combustion gases 52. The combustion gases 52 cause the high pressure turbine 22 and the low pressure turbine 24 to rotate respectively, for powering the high pressure compressor 18, the low pressure compressor 16, and the fan blades 14. Surrounding the fan blades 14 and the upstream portion of the casing 32, is a short cowl nacelle 44 which is spaced radially outwardly from the casing 32 to define with the casing 32, an annular duct 55 for permitting the radially outer portion of the air 36 compressed by the fan blades 14 to bypass the engine 10. A plurality of circumferentially spaced stator vanes 46 extend radially between the casing 32 and the nacelle 44, and are axially spaced apart downstream of the fan blades 14. The nacelle 44 includes an inlet 48 at its upstream end for receiving the ambient air 36, and an outlet 50 for discharging the portion of air 36 which has been compressed by the fan blades 14 and passed over the stator vanes 46, in order to provide a portion of thrust.

Inter-stage compressor bleed air is introduced, for example by an air passage which is schematically shown and indicated by numeral 58, to the turbine shroud support configuration 100 for cooling same and thereby controlling turbine tip clearance. A switching valve 60 is provided for controlling the inter-stage bleed air passing through the passage 58. Full pressure compressed air is also introduced, for example by a passage which is schematically shown and indicated by numeral 62, to the turbine shroud support configuration 100.

Figure 2:
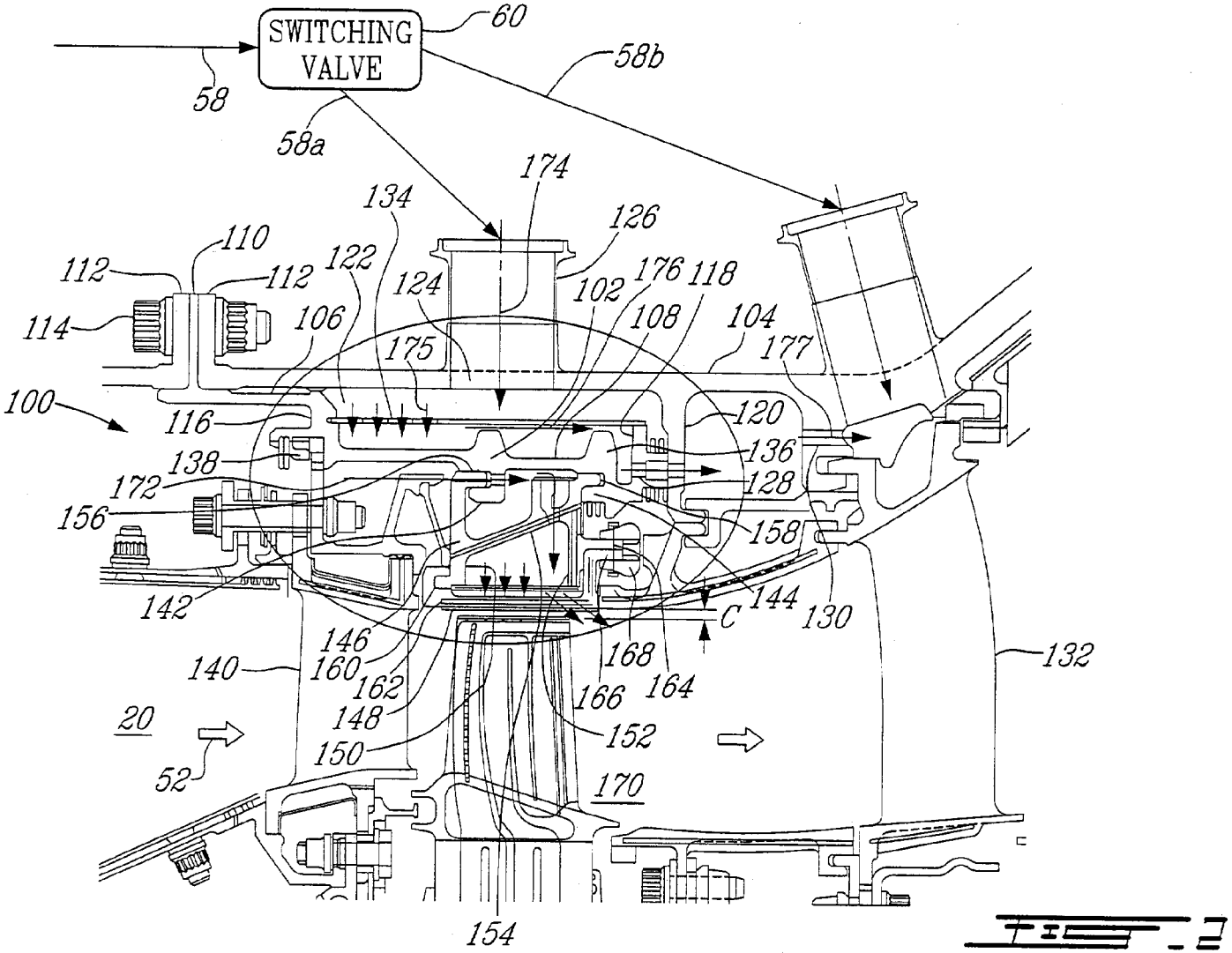
FIG. 2 is a longitudinal cross-sectional of a turbine shroud support configuration used in the embodiment shown in FIG. 1.
Figure 3:
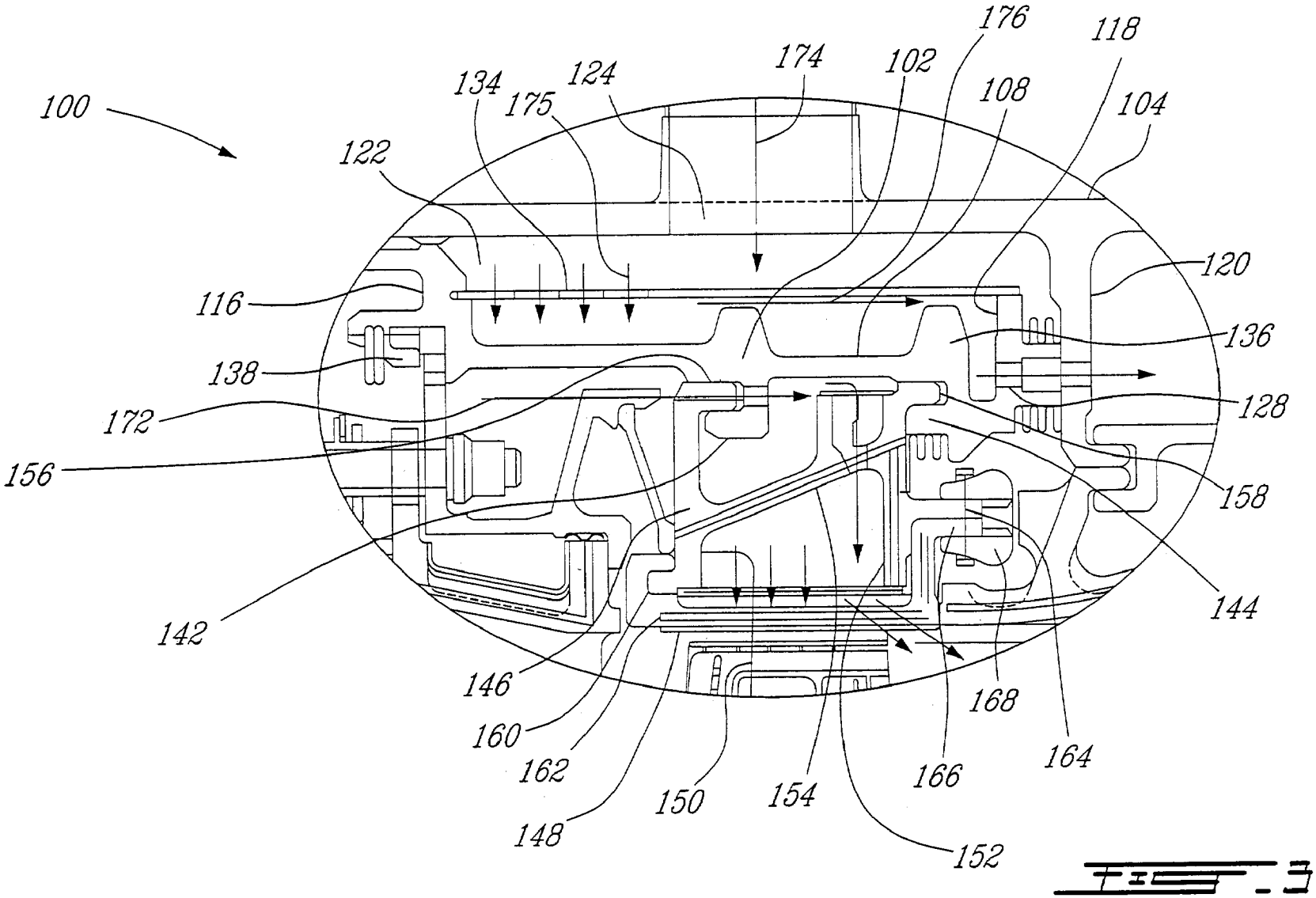
FIG. 3 is an enlarged center portion of FIG. 2, more clearly illustrating the features of the invention.

The turbine shroud support configuration 100 according to one embodiment of the present invention as illustrated in FIG. 2 includes an integral annular shroud housing 102 secured within a turbine support casing 104 which is part of the annular casing 32 shown in FIG. 1. A number of the components of the turbine shroud support configuration are more clearly illustrated in an enlarged scale, as shown in FIG. 3. The annular shroud housing 102 generally includes an upstream axial section 106 and a downstream axial section 108. The upstream axial section 106 has an external diameter slightly smaller than the inner diameter of the turbine support casing 104 and includes an external radial flange 110. Thus, the upstream axial section 106 of the annular shroud housing 102 can be appropriately supported within the shroud support casing 104 when the external radial flange 110 thereof is sandwiched between flanges 112 of two sections of the turbine support casing 104 and is secured by mounting screws 114.

The downstream axial section 108 of the annular shroud housing 102 has a diameter smaller than the diameter of the upstream axial section 106 and is connected to the upstream axial section 106 by a radial front wall 116 so that the downstream axial section 108 is radially spaced apart from the turbine support casing 104. An aft radial wall 118 is provided to the downstream axial section 108 at an aft end thereof, and abuts an inner radial wall 120 of the turbine support casing 104, thereby forming an annulus 122 defined between the turbine support casing 104 and the downstream axial section 108 of the annular shroud housing 102. The annulus 122 is axially aligned with a plurality of air passages 124 passing through a number of support vanes 126 which are circumferentially spaced apart from one another to support the turbine support casing 104 within the engine structure. The air passages 124 are in fluid communication with air passage 58 shown in FIG. 1, for introducing the inter-stage compressor bleed air, as indicated at numeral 174. A plurality of openings 128 are defined in the aft radial wall 118 of the annular shroud housing 102, in fluid communication with a downstream air passage 130 which is adapted to direct a cooling air flow to a downstream turbine component, for example a plurality of low pressure turbine stage one vanes 132.

An annular impingement skin 134 is provided within the annulus 122 and is secured at opposed ends to the respective front and aft radial walls 116 and 118. The impingement skin 134 includes a plurality of small holes therein (not shown) to permit cooling air 174 under pressure, to pass therethrough, thereby forming fine air jets impinging on the downstream axial section 108 of the annular shroud housing 102. A plurality of fins 136 are provided on the external surface of the downstream axial section 108 of the annular shroud housing 102, to increase contact areas with the cooling air flow and thereby improve its cooling efficiency.

The front radial wall 116 of the annular shroud housing 102 includes securing devices 138 for secure connection to a plurality of high pressure turbine vanes 140. An annular front hook 142 and an annular rear hook 144 are provided to the inner surface of the downstream axial section 108 of the annular shroud housing 102, for supporting a plurality of shroud support segments 146. The shroud support segments 146 form an annular ring assembly to secure the turbine shroud assembly which is formed by shroud segments 148 within the annular shroud housing 102. Each shroud support segment 146 includes front and aft radial walls 150 and 152, interconnected by an axial wall 154. Hooks 156 and 158 are provided at the top of respective front and aft radial walls 150 and 152, and engage the respective hooks 142 and 144 of the annular shroud housing 102, so that each shroud support segment 146 is securely supported within the annular shroud housing 102. A front leg 160 extending from a lower end of the front radial wall 150 engages a hook 162 of a corresponding shroud segment 148, and an aft leg 164 is securely attached to an aft leg 166 of the corresponding shroud segment 148 by a conventional C-clip 168. Thus, the shroud segments 148 are securely installed within an annular ring assembly formed by the shroud support segments 146 which in turn are securely supported within the annular shroud housing 102. The axial position of the shroud support segments 146 are restrained between the rear hook 144 of the annular shroud housing 102 and, a support structure attached to the high pressure turbine vanes 140.

Openings (not indicated) provided in each shroud support segment 146, together with clearances (not shown) between adjacent shroud support segments 146, form an air passage which is in fluid communication with combustion gas path 170 defined within the turbine shroud assembly, and is also in fluid communication with the air passage 62 shown in FIG. 1, so that full pressure compressor-delivered air, as indicated at numeral 172, can flow through the shroud support segments 146 to cool both the shroud support segments 146 and the shroud segments 148, independently from the cooling air flow 174 which is isolated from joining the air flow 172 by the annular shroud housing 102, and is then discharged through the air passages in and between the shroud segments 148, into the combustion gas path 170.

Referring now to both FIGS. 1 and 2, during operation, full pressure compressor-delivered air 172 is introduced through the air passage within the shroud support segments 146, to cool both the shroud support segments 146 and the shroud segments 148 during engine startup, and is then continuously supplied during the entire engine operation process. The air flow 172 also functions as an air seal around the shroud segments 148 and is then forced to pass through the passages in and between the shroud segments 148, surrounding the turbine blade tips before being discharged through the combustion gas path 170, in order to prevent combustion gas leakage. Therefore, the air flow 172 requires relatively high pressure and the full pressure compressor-delivered air is a preferable source, although the temperature thereof is relatively high, which reduces its cooling efficiency and thereby its flexibility for turbine tip clearance control. Nevertheless, this problem is addressed with the use of cooling air flow 174.

The switching valve 60 is connected in the air passage 58 and has an "on" position and preferably an "off" position. When the switching valve 60 is in the "on" position, the air flow passing through the air passage 58 is diverted into branch air passage **58*a* with preferably 50 percent flow thereof, and into branch air passage 58*b* with preferably the other 50 percent flow thereof. When the switching valve 60 is in the "off" position, the branch air passage 58*a* is shut off and the entire air flow from air passage 58 is directed into branch air passage 58*b*. Although a complete 'shut-off' of passage 58*a* is preferred here, for reasons described below, it is not necessary and the respective flows through passages 58*a* and 58*b*** can be selected by the designer as desired.

Generally, during the engine startup period ("startup period" being used to refer here to an engine start, run-up or other transient operating condition in the engine operating cycle), the switching valve 60 is in the "off" position and the inter-stage compressor bleed air from passage 58 passes through the branch air passage **58*b* to cool the downstream components of the turbine, such as low pressure turbine (LPT) stator and/or vanes 132. When the engine has reached cruise and stabilized thermally such that the pinch-point has been avoided, the switching valve 60 is activated to its "on" position so that about 50 percent (preferably) of the inter-stage compressor bleed air flow is directed from passage 58 through branch air passage 58*a*, to provide the cooling air flow 174 for cooling the annular shroud housing 102. Meanwhile, the remaining inter-stage compressor bleed air flow is directed through branch air passage 58*b* to continue cooling the downstream turbine components. The cooling air flow 174 is directed to pass through the impingement skin 134 (as represented by arrows 175 in FIGS. 2 and 3) to thereby impinge on the annular shroud housing 102 and then flow along the external surface of the annular shroud housing 102 (as represented by arrow 176 in FIGS. 2 and 3), passing fins 136 thereof to further cool the annular shroud housing 102, before being discharged through the downstream air passage 130 (as represented by arrow 177 in FIG. 2) in order to cool the downstream turbine components such as the low pressure turbine [LPT] vanes and/or stator 132. The air flow 174 is not discharged into the combustion gas path 170 and therefore requires only a relatively low pressure (relative to the P3 flow) to deliver the air flow 174 for cooling the engine components until the pressure is completely lost. The inter-stage compressor bleed air has a relatively lower temperature and a low air pressure, and is therefore a preferable source of cooling air 174 than using P3 air, when possible. Thus, the cooling air flow 174 not only provides an additional cooling, with respect to the cooling provided by air flow 172, to the entire turbine shroud and support structure to improve cooling efficiency, but also provides more flexibility for tuning turbine tip clearance because of the relatively low temperature of the cooling air source. The re-use of the shroud cooling air flow 174** advantageously minimizes parasitic secondary air system loses of engine performance.

The switching valve 60 can be any suitable valving or switching, or other means for controlling the flow of air directed to provide turbine tip clearance cooling as described above. The switching valve 60 can be controlled at any time during the engine operation, to control the turbine tip clearance during various engine operative conditions.

Passages 58 and 62 in FIG. 1 are exemplary, schematically illustrating the respective cooling air sources, and are not intended to be limited to any particular structural arrangement for obtaining the respective inter-stage compressor bleed air (i.e. P2.X) and full pressure (i.e. P3) compressor delivered air. It will be understood that these can be achieved using a variety of known arrangements.

One skilled in the art will understand, in light of this disclosure, that switching valve 60 may be replaced by any functional equivalent which permits the air flow through air passage 58*a* to be controlled, restricted or stopped, as desired by the designer. For example, a simple open/closed valve or other flow control member may be placed downstream of the branch between passages 58*a* and 58*b*. Other configurations will also be apparent to the skilled reader and thus are not intended to be outside the scope of the present disclosure.

The cooling system and turbine tip clearance control method of the present invention is not applied only to the short cowl nacelle engines which are taken as an example to illustrate the applications of the present invention. The present invention can be applied to various types of gas turbine engines without departing from the spirit of this invention. Though the use of P2.X interstage compressor air is of course preferred, it is only preferred and thus not necessary.

Modifications and improvements to the above-described embodiment of the present invention may become apparent to those skilled in the art. The foregoing description is intended to be exemplary rather than limiting. The scope of the invention is therefore intended to be limited solely by the scope of the appended claims.

What is claimed is:

1. A gas turbine engine having a plurality of turbine rotor blades and a turbine shroud assembly, the turbine shroud assembly including a plurality of turbine shroud segments radially spaced apart from the plurality of turbine rotor blades, the gas turbine engine further comprising:

an annular shroud housing adapted to be secured within a turbine support casing;

turbine shroud segment attachment members mounted to an inner side of the annular shroud housing and adapted to support the turbine shroud segments in place;

a first cooling air passage adapted to direct a first cooling air flow from a compressor portion of the gas turbine engine to at least one gas turbine engine component downstream of the shroud housing relative to a combustion gas path through the gas turbine engine;

a second cooling air passage branching from the first cooling air passage and adapted to direct a second cooling air flow from the first cooling passage to the shroud housing to cool the shroud housing and thereby affect the tip clearance between the turbine shroud segments and the turbine rotor blades;

a flow control member associated with the second cooling air passage and adapted to selectively control a cooling air flow passing through the second cooling air passage, the flow control member cooling air being selectively positionable between a first position, in which a first cooling air flow rate is permitted to pass through the second cooling air passage, and a second position, in which a second cooling air flow rate is permitted to pass through the second cooling air passage; and a third cooling air passage isolated from the second air passage, adapted to direct a third cooling air flow both for cooling the turbine shroud segment attachment members and the turbine shroud segments and for creating an air seal around the turbine shroud segments in order to prevent combustion gas leakage.

2. A gas turbine engine as claimed in claim 1 wherein, the second cooling air passage is defined at least by the shroud housing, and is isolated from a section of the combustion gas path defined within the turbine shroud assembly.

3. A gas turbine engine as claimed in claim 2 wherein the second cooling air passage is in fluid communication with a downstream cooling air passage of the gas turbine engine so that the cooling air flow passing to the shroud housing from the second cooling air passage is redirected therefrom to further cool a turbine component downstream of the turbine rotor blades relative to the combustion gas path.

4. A gas turbine engine as claimed in claim 3 wherein the second cooling air flow rate is substantially zero.

5. A gas turbine engine as claimed in claim 1 wherein the turbine shroud segment attachment members comprise a plurality of shroud support segments forming an annular ring assembly to secure the turbine shroud assembly within the shroud housing, the annular ring assembly defining said third cooling air passage.

6. A gas turbine engine as claimed in claim 5 wherein the third cooling air passage is adapted to be in fluid communication with the combustion gas path defined within the turbine shroud assembly so that the third cooling air flow is adapted to be discharged into the combustion gas path after having cooled the turbine shroud assembly.

7. A gas turbine engine as claimed in claim 6 wherein the first cooling air passage is adapted to be in fluid communication with an upstream cooling air passage for intake of a compressor bleed air flow, and wherein the third cooling air passage is adapted to be in fluid communication with an upstream cooling air passage for intake of full pressure compressor air to form the third cooling air flow.

* * * * *